US005642857A

United States Patent [19]

Totsuka et al.

[11] Patent Number: 5,642,857

[45] Date of Patent: Jul. 1, 1997

[54] CONTROL APPARATUS FOR MULTI-AIR-CONDITIONER

[75] Inventors: Hidekazu Totsuka; Kenshi Kawagishi; Yasunori Shida; Kazuyuki Mitsushima; Yukihiko Iwata, all of Tokyo, Japan

[73] Assignee: Mitsubishi Denki Kabushiki Kaisha, Tokyo, Japan

[21] Appl. No.: 607,928

[22] Filed: Feb. 28, 1996

[30] Foreign Application Priority Data

Mar. 30, 1995 [JP] Japan ..... 7-072606

[51] Int. Cl.[6] ..... F24F 11/02

[52] U.S. Cl. ..... 236/51; 62/175

[58] Field of Search ..... 236/51, 1 B; 62/175, 62/126, 127, 510; 165/205, 207, 208, 209

[56] References Cited

U.S. PATENT DOCUMENTS

| | | | |
|---|---|---|---|
| 5,263,335 | 11/1993 | Isono et al. | 62/229 |
| 5,383,336 | 1/1995 | Nishida et al. | 236/51 X |
| 5,390,506 | 2/1995 | Sogabe et al. | 62/175 |
| 5,435,147 | 7/1995 | Mochizuki et al. | 165/209 X |
| 5,499,510 | 3/1996 | Yoshida et al. | 236/51 X |
| 5,522,230 | 6/1996 | Shima et al. | 62/175 X |

FOREIGN PATENT DOCUMENTS

| | | |
|---|---|---|
| 62-91744 | 4/1987 | Japan . |
| 62-91745 | 4/1987 | Japan . |
| 63-306346 | 12/1988 | Japan . |

*Primary Examiner*—Harry B. Tanner

*Attorney, Agent, or Firm*—Oblon, Spivak, McClelland, Maier & Neustadt, P.C.

[57] ABSTRACT

A control apparatus for a multi-air-conditioner having an external unit and a plurality of internal units includes a DC electric power supply. An external transmitting/receiving circuit is provided with the external unit and is connected with the DC electric power supply, and a plurality of internal transmitting/receiving circuits are provided with the plurality of internal units and are connected serially with the external transmitting/receiving circuit via a signal line. A DC voltage is supplied for transmitting data from the external unit to the internal unit, which reduces a leakage distance of the circuit. A timing for transmitting data can be set freely, a transmitting speed of data can be improved using a high-speed photo-coupler, and thus an operation speed of the internal unit can be improved in the multi-air-conditioner having the plurality of internal units.

20 Claims, 14 Drawing Sheets

CONTROL APPARATUS FOR MULTI-AIR-CONDITIONER

BACKGROUND OF THE INVENTION

1. Field of the Invention

This invention relates to a control apparatus for a multi-air-conditioner having an external unit and a plurality of internal units, especially to a control apparatus for a multi-air-conditioner which transmits data using a direct current (DC) voltage for a power supply to a transmitting/receiving circuit.

2. Description of the Related Art

Conventionally, a serial transmitting system, in which a plurality of data is transmitted serially in time-series with one signal line, is used for controlling an operation between an external unit and a plurality of internal units of a multi-air-conditioner. An example of a circuit of a related control apparatus for a multi-air-conditioner is shown in FIG. 12. The control apparatus is disclosed in Japanese Unexamined Patent Publication No. SHO 63-306346. In FIG. 12, an external unit 1 is connected to a plurality of internal units 2, 3 and 4, respectively, via commercial power supply lines R, S and a signal line 5. A transmitting/receiving circuit 6 is provided between the commercial power supply line R and the commercial power supply line S in each unit. In the transmitting/receiving circuit 6, a transmitting switch 7 is provided for supplying commercial power (alternating current (AC) power) alternatively according to data transmitted from a controller 9. A signal detector 8 is also provided serially with the transmitting switch 7 in the transmitting/receiving circuit 6 for informing the controller 9 whether the transmitting/receiving circuit 6 is supplied with power or not. Each part of the circuit connecting the transmitting switch 7 and the signal detector 8 in the external unit and the internal units is wired to each other via the signal line 5.

An operation of the circuit of FIG. 12 will be described hereinafter. In the above control apparatus, a photo-coupler is provided with the transmitting switch 7 for supplying the transmitting/receiving circuit 6 with the commercial power alternatively according to data transmitted from the controller 9. The photo-coupler consists of an emitter 71, which emits an optical signal and is driven in a driving circuit 13 connected to an output port PO of the controller 9, and a receiver 72, which receives an optical signal from the emitter 71 and which is capable of supplying or cutting off power supply in both directions.

In the control apparatus, another photo-coupler is provided with the signal detector 8 for supplying or cutting off power to a transistor of a receiving circuit 14 provided in the previous stage of an input port PI of the controller 9. The photo-coupler consists of an emitter 81, which emits an optical signal and is driven by plus/minus AC current passing through the transmitting/receiving circuit 6, and a receiver 82, which receives the optical signal from the emitter 81. The input port PI is set to a high level "H" or a low level "L" according to ON or OFF of the transistor Tr of the receiving circuit 14, which is caused by supplying/cutting off power of the receiver 82.

Data is transmitted to the transmitting switch 7 from the controller 9 synchronously with the commercial power supply. That is, pulsating data is transmitted including a high level "H", which corresponds to a logic level "1" output to the output port PO, and a low level "L", which corresponds to a logic level "0". Transmitting data is synchronized with an integral times of a half-wave of the commercial power supply to output. The data is received at the signal detector 8 by detecting a waveform of plus or minus electric current supplied or cut off to the transmitting/receiving circuit 6 every integral times of the half-wave.

An example of a control apparatus for a separate-air-conditioner including an external unit and an internal unit is shown in FIG. 13. This air-conditioner uses a DC voltage for a power supply to a transmitting/receiving circuit for transmitting data to control an operation between the external unit 1 and the internal unit 2. In FIG. 13, a transmitting/receiving circuit 6 of an external unit 1 is connected to a transmitting/receiving circuit 6 of an internal unit 2 serially via a power supply line S and a signal line 5. AC power "e" is rectified to a DC voltage by a resistance $R_1$ for dissipating current, a rectifier diode $D_1$, a Zener diode $ZD_1$ for restricting voltage and a smoothing capacitor $C_1$. The rectified DC voltage is about 25 V, so that a semiconductor capable of withstanding a normal voltage can be used in the transmitting/receiving circuit 6. Also in the above rectifying circuit, a leakage distance can be short.

The following elements are connected to the transmitting/receiving circuit 6 of the external unit 1 for protecting the transmitting switch 7 (this transmitting switch 7 is also called "a photo-coupler for external transmission", hereinafter) and signal detector 8 (also called "a photo-coupler for external receipt", hereinafter) against a case of a miswiring: a Diode $D_2$ capable of cutting off the commercial power; a resistance $R_2$ for dissipating current; and a diode $D_3$ capable of cutting off the commercial power for decreasing a voltage of the transmitting switch 7 and the signal detector 8.

To the transmitting/receiving circuit 6 of the internal unit 2, the following elements are connected for protecting the transmitting switch 7 (this is also called "a photo-coupler for internal transmission", hereinafter) and the signal detector 8 (also called "a photo-coupler for internal receipt", hereinafter) against a case of a miswiring: a resistance $R_3$; a diode $D_4$ capable of cutting off the commercial power; and a Zener diode $D_2$.

The control apparatus of the device of FIG. 13 differs from the control apparatus of the device of FIG. 12 in having unidirectional photo-couplers in the transmitting switch 7 and the signal detector 8 of the transmitting/receiving circuit 6, respectively.

An operation of the device of FIG. 13 will now be explained.

Transmitting data from the external unit 1 to the internal unit 2 is explained referring to FIG. 14. While the photo-coupler 7 for internal transmission is kept ON, turning the photo-coupler 7 for external transmission ON/OFF causes the photo-coupler 8 for internal receipt to turn ON/OFF to transmit the signal. At this time, the photo-coupler 8 for external receipt is also turned ON/OFF simultaneously.

In FIG. 15, data is transmitted to the external unit 1 from the internal unit 2. While the photo-coupler 7 for external transmission is kept ON, turning the photo-coupler 7 for internal transmission ON/OFF causes the photo-coupler 8 for external receipt to turn ON/OFF for transmitting the signal. At this time, the photo-coupler 8 for internal receipt is also turned ON/OFF simultaneously.

The controller 9 controls transmission of data alternatively in the directions from the internal unit to the external unit or from the external unit to the internal unit.

An operation will now be explained in a case that the commercial power is miswired to the signal line 5 and the power supply line S.

(1) Protection in a case that the signal line 5 of the external unit 1 and the power supply line S are miswired.

(1-1) A period when the signal line 5 is plus and the power supply line S is minus.

In this case, the diodes $D_2$ and $D_3$ remain OFF, which causes no influence to the photo-coupler 7 for external transmission and the photo-coupler 8 for external receipt.

(1-2) A period when the signal line 5 is minus and the power supply line S is plus.

In this case, the diode $D_3$ is turned ON to pass electric current from the diode $D_3$ to the resistance $R_2$, however, the diode $D_3$ is protected by dissipating electric current with the resistance $R_2$. When the diode $D_3$ is turned ON, the photo-coupler 7 for external transmission and the photo-coupler 8 for external receipt receive voltage of only $V_F$ from the diode $D_3$, which hardly influences the photo-coupler 7 for external transmission and the photo-coupler 8 for external receipt.

(2) Protection in a case that the signal line 5 of the internal unit 2 and the power supply line S are miswired.

(2-1) A period when the signal line 5 is plus and the power supply line S is minus.

In this case, the diode $D_4$ is turned ON to pass electric current to the transmitting/receiving circuit 6. However, the voltage received at the transmitting/receiving circuit 6 is decreased to almost 30 V by the resistance $R_3$ and the Zener diode $ZD_2$, thus the photo-coupler 7 for internal transmission and the photo-coupler 8 for internal receipt are protected.

(2-2) A period when the signal line 5 is minus and the power supply line S is plus.

In this case, the diode $D_4$ is turned OFF to receive all voltages and the Zener diode $ZD_2$ receives only $V_F$ (almost 1 V). The photo-coupler 7 for internal transmission and the photo-coupler 8 for internal receipt are thus protected.

When a part of the circuit between the signal line 5 and the power supply line R becomes short-circuited, a short-circuit current runs from the transmitting/receiving circuit 6 to the diode $D_2$, and to the resistance $R_2$ in the external unit 1. In this case, however, the resistance $R_2$ dissipates the short-circuit current, and thus the photo-coupler 7 for external transmission, the photo-coupler 8 for external receipt and the diode $D_2$ are protected.

The control apparatus for the related multi-air-conditioner is configured as described above. In the related art of FIG. 12, the control apparatus includes only one signal line 5 and a pair of commercial power supply lines R and S to transmit and receive data between the external unit 1 and a plurality of the internal units 2–4. However, a transmitting timing of data should be synchronized with the commercial power supply, which causes the transmitting speed of data to be limited to 100 bps (bit per second) at a maximum in a case of commercial power supply 50 Hz, and to 120 bps (bit per second) at a maximum in a case of commercial power supply 60 Hz. In the related art of FIG. 12, commercial power is supplied to each transmitting/receiving circuit 6. The photo-coupler 7 for transmission should have a receiver capable of withstanding a high voltage to supply commercial power bidirectionally or to cut off power. The photo-coupler 8 for receipt should have an emitter capable of being driven bidirectionally. This causes the conventional control apparatus to have a high cost.

When the related art of FIG. 13 is applied to the multi-air-conditioner, a plurality of the circuits of the internal units are connected in parallel. The external unit 1 transmits data to the plurality of internal units 2, and thus the voltage between the signal line 5 and the power supply line S is decreased and enough electric current cannot be supplied to each of the plurality of internal units 2 without an extra circuit.

SUMMARY OF THE INVENTION

Accordingly, one object of the present invention is to provide a novel control apparatus for a multi-air-conditioner which overcomes the drawbacks of the related art devices.

To solve the above problems, the present invention provides a novel control apparatus for a multi-air-conditioner using a DC voltage to supply to a transmitting/receiving circuit for transmitting/receiving data between one external unit and a plurality of internal units via a pair of commercial power supply lines and one signal line. The control apparatus thus transmits data at any timing, that is, the timing does not need to be synchronized with a commercial power supply. A unidirectional photo-coupler, which has a low cost, can be used in the transmitting/receiving circuit for protecting the circuit elements in a case of a miswiring.

According to the invention, a control apparatus for a multi-air-conditioner having an external unit supplied with electric power from an AC electric power supply and a plurality of internal units, a first AC power supply line and a second AC power supply line for supplying the plurality of internal units with electric power from the external unit and a signal line for transmitting data to control an operation of the multi-air-conditioner, the control apparatus includes a DC electric power supply provided with the external unit for rectifying the AC electric current from the AC electric power supply to a DC electric current, an external transmitting/receiving circuit provided with the external unit and connected with the DC electric power supply, a plurality of internal transmitting/receiving circuits respectively provided with the plurality of internal units and connected serially with the external transmitting/receiving circuit via the signal line, wherein the DC electric power supply, the external transmitting/receiving circuit, the signal line, the plurality of internal transmitting/receiving circuits and the first AC power supply line form a closed circuit, and wherein the plurality of internal transmitting/receiving circuits are connected in parallel with each other between the signal line and the first AC power supply line.

According to the invention, a control method for a multi-air-conditioner having an external unit and a plurality of internal units connected with a signal line, includes the steps of (a) supplying the external unit and the plurality of internal units with AC electric current from an AC power supply, (b) rectifying the AC electric current supplied at the supplying step to a DC electric current, (c) setting the plurality of internal units to a receiving state on starting the rectifying step, (d) transmitting data by alternatively supplying the signal line with DC electric current based on data transmitted from the external unit after setting the plurality of internal units to the receiving state at the setting step, and (e) receiving data at each of the plurality of internal units by detecting whether the plurality of internal units are supplied with electric current or not at the transmitting step.

According to the invention, a control method for a multi-air-conditioner having an external unit and a plurality of internal units connected with a signal line, includes the steps of (a) supplying an AC electric current to the external unit and the plurality of internal units from an AC electric power supply, (b) rectifying the AC electric current supplied at the supplying step to a DC electric current, (c) transmitting data to the plurality of internal units from the external unit via the signal line, (d) setting the external unit to a receiving state after transmitting data at the transmitting step, (e) transmitting data time-divisionally and serially from the plurality of internal units to the signal line after setting the external unit to the receiving state at the setting step, and (f) receiving data of the plurality of internal units serially from the signal line by the external unit.

According to the invention, a control apparatus for a multi-air-conditioner having an external unit supplied with power from at least one commercial power supply line and a plurality of internal units connected with a signal line for serially transmitting data between the external unit and the plurality of internal units to control an operation of the multi-air-conditioner, the control apparatus includes a DC electric power supply for rectifying commercial electric power supply supplied to the external unit to a DC electric power supply, an external transmitting/receiving circuit connected to the DC electric power supply, a plurality of internal transmitting/receiving circuits respectively provided with the plurality of internal units and connected serially with the external transmitting/receiving circuit via the signal line, wherein the DC electric power supply, the external transmitting/receiving circuit, the signal line, the plurality of internal transmitting/receiving circuits and the at least one commercial power supply line form a closed circuit, wherein the plurality of internal transmitting/receiving circuits of the plurality of internal units are connected in parallel to each other between the signal line and the at least one commercial power supply line, and wherein each of the external transmitting/receiving circuit and the plurality of internal transmitting/receiving circuits comprises a transmitting switch for alternatively supplying the transmitting/receiving circuit with the DC electric power supply based on data transmitted from a controller, and a signal detector connected serially with the transmitting switch for detecting whether the transmitting/receiving circuit is supplied with power or not and outputting the detected data as a receiving data to the controller.

BRIEF EXPLANATION OF THE DRAWINGS

A more complete appreciation of the present invention and many of the attendant advantages thereof will be readily obtained as the same becomes better understood by reference to the following detailed description when considered In connection with the accompanying drawings, wherein.

DESCRIPTION OF THE PREFERRED EMBODIMENT

Figure 13:
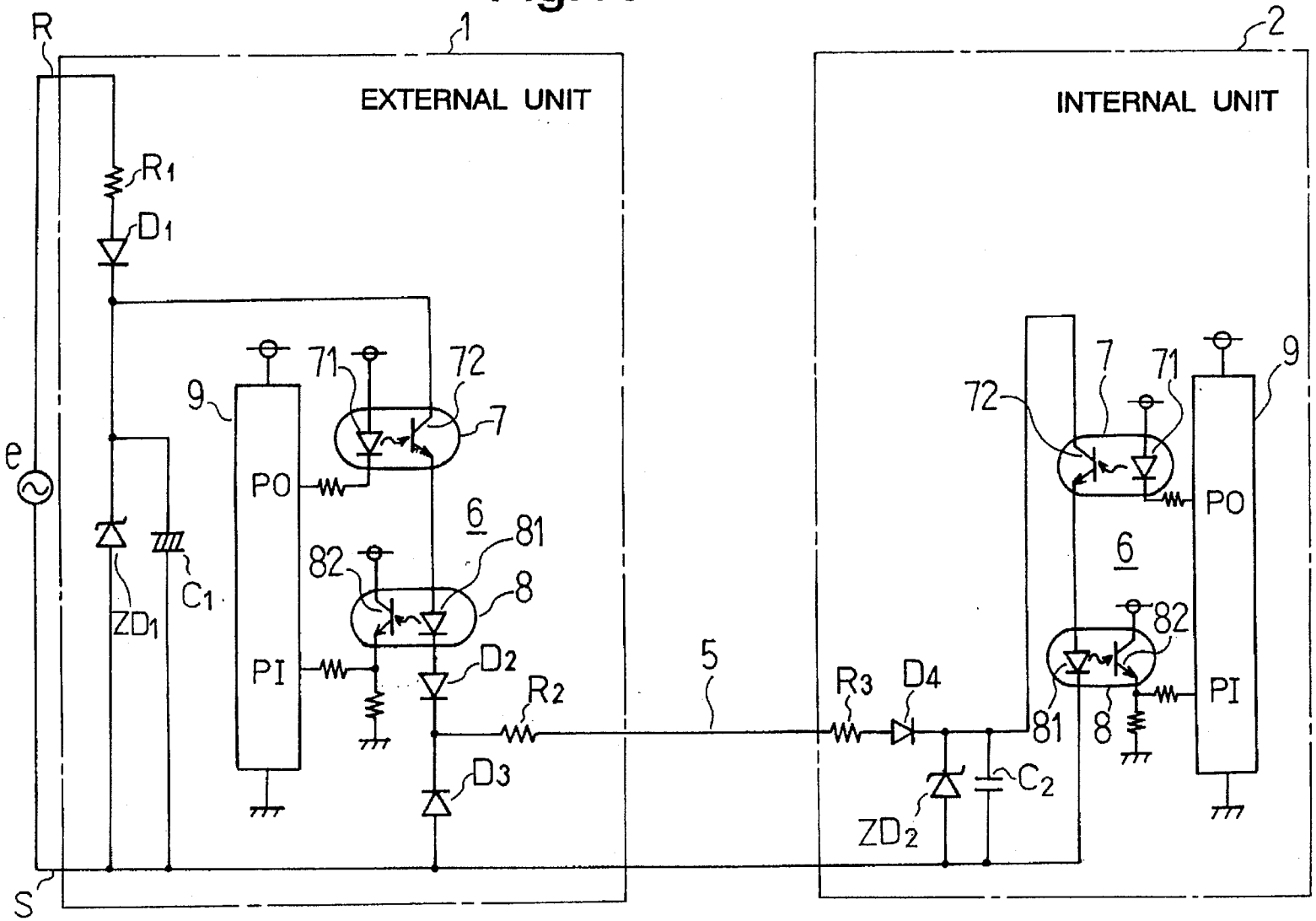
Fig.13 RELATED ART
FIG. 13 shows a circuit of another conventional control apparatus for a multi-air-conditioner according to Related Art.
Figure 14:
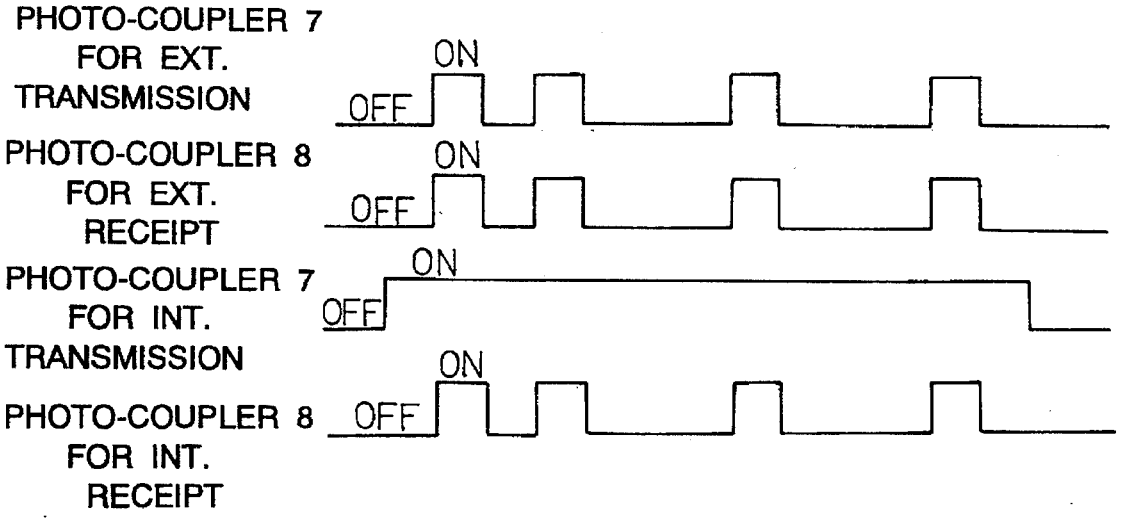
Fig.14 RELATED ART
FIG. 14 explains a transmitting operation from an external unit to an internal unit of the control apparatus of the Related Art.
Figure 15:
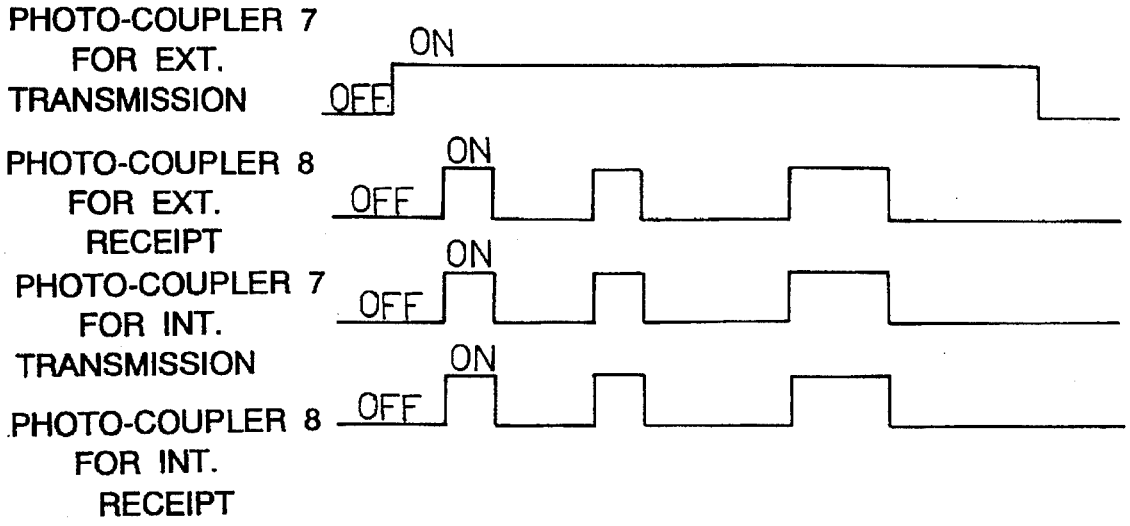
Fig.15 RELATED ART
FIG. 15 explains a transmitting operation from the internal unit to the external unit of the control apparatus of the Related Art.

When a transmitting/receiving circuit is supplied with a DC voltage using a power supplying circuit of the related art of FIG. 13 in a multi-air-conditioner, where a plurality of internal units 2–4 are connected serially to an external unit 1 via a signal line 5, the voltage between the signal line 5 and the power supply line R, S is decreased. When the external unit 1 transmits data to the plurality of internal units 2–4 simultaneously, more electric current needs to run through the transmitting/receiving circuit, the resistance $R_2$ and the diode $D_2$ than in the case of the related art of FIG. 13, where the air-conditioner is the separate-air-conditioner consisting of one external unit 1 and one internal unit 2. To avoid this decrease of the voltage, the value of the resistance $R_2$ for restricting electric current needs to be reduced. However, when the value of the resistance $R_2$ is reduced, there is a problem that the resistance $R_2$ consumes much electric power in a case that commercial power is miswired between the signal line and the power supply line because much electric current runs through the circuit from the diode $D_3$ to the resistance $R_2$. In the present Invention, the diode $D_3$ is removed to solve the above problem. The photo-coupler for external transmission/receipt is protected by making the photo-coupler for transmission capable of withstanding a high voltage instead of providing the diode $D_3$. In this way, a DC voltage can be supplied to the transmitting/receiving circuit of the control apparatus for the multi-air-conditioner by the power supplying circuit of the related art of FIG. 13.

Figure 1:
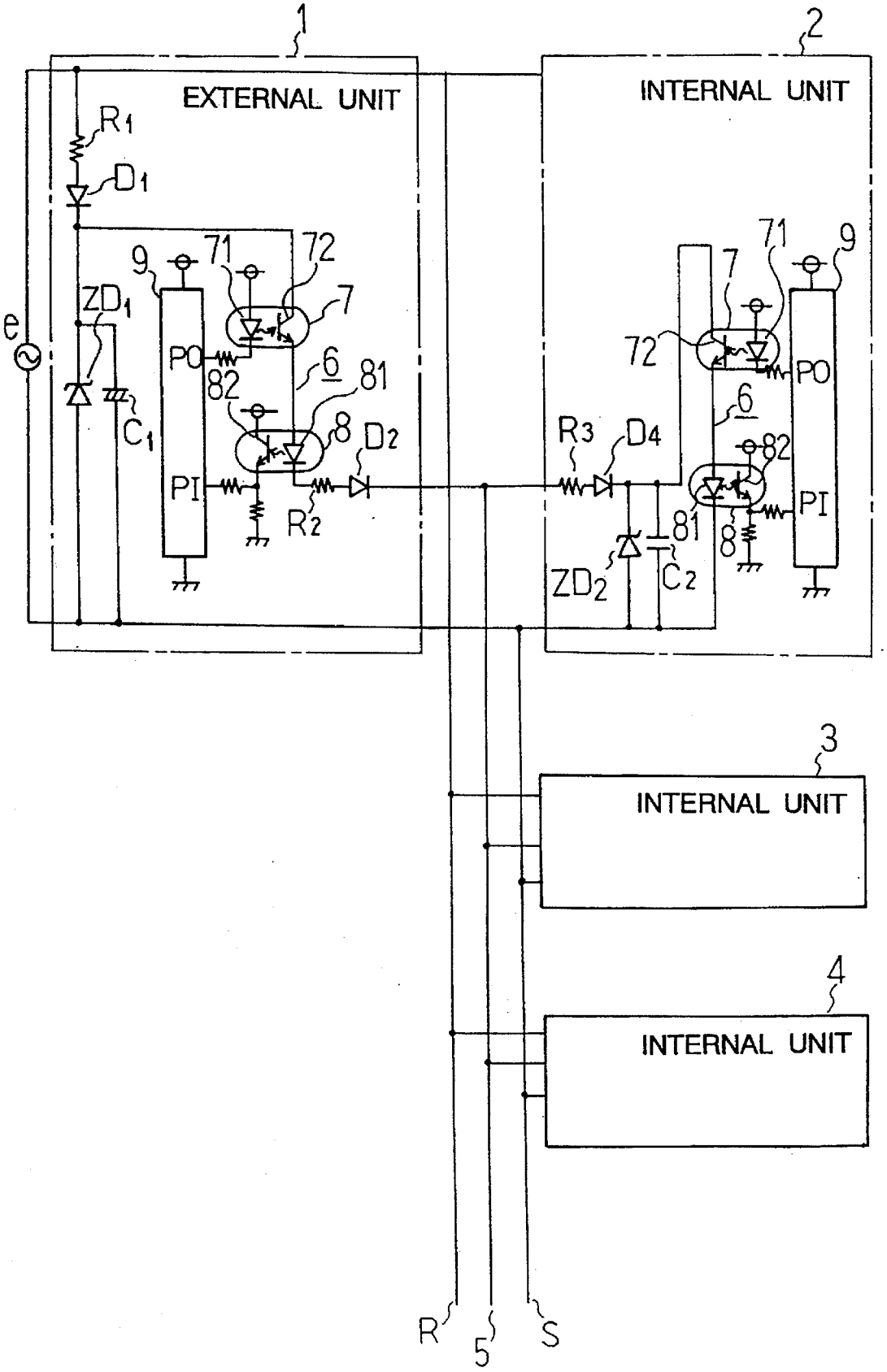
FIG. 1 shows a circuit of a control apparatus for a multi-air-conditioner according to a first embodiment of the present invention.

FIG. 1 shows a circuit of a control apparatus for a multi-air-conditioner according to a first embodiment of the present invention. In FIG. 1, the same reference numerals and symbols are used for the same or similar elements of the related art of FIG. 13 except internal units 3 and 4. The internal units 3 and 4 are wired in parallel to the internal unit 2. The internal units 3 and 4 have the same circuits 6 (not shown) as the transmitting/receiving circuits 6 of the internal unit 2. Transmitting/receiving circuits 6 of the internal units 3 and 4 are wired to the transmitting/receiving circuit 6 of the internal unit 2 in parallel. A receiver 72 of a transmitting switch 7 of the external unit 1 is capable of withstanding a high voltage to cut off a commercial power supply. The value of resistance $R_2$ is set to enough of a resistance value to transmit data from the external unit 1 to the internal units 2–4 simultaneously.

Figure 2:
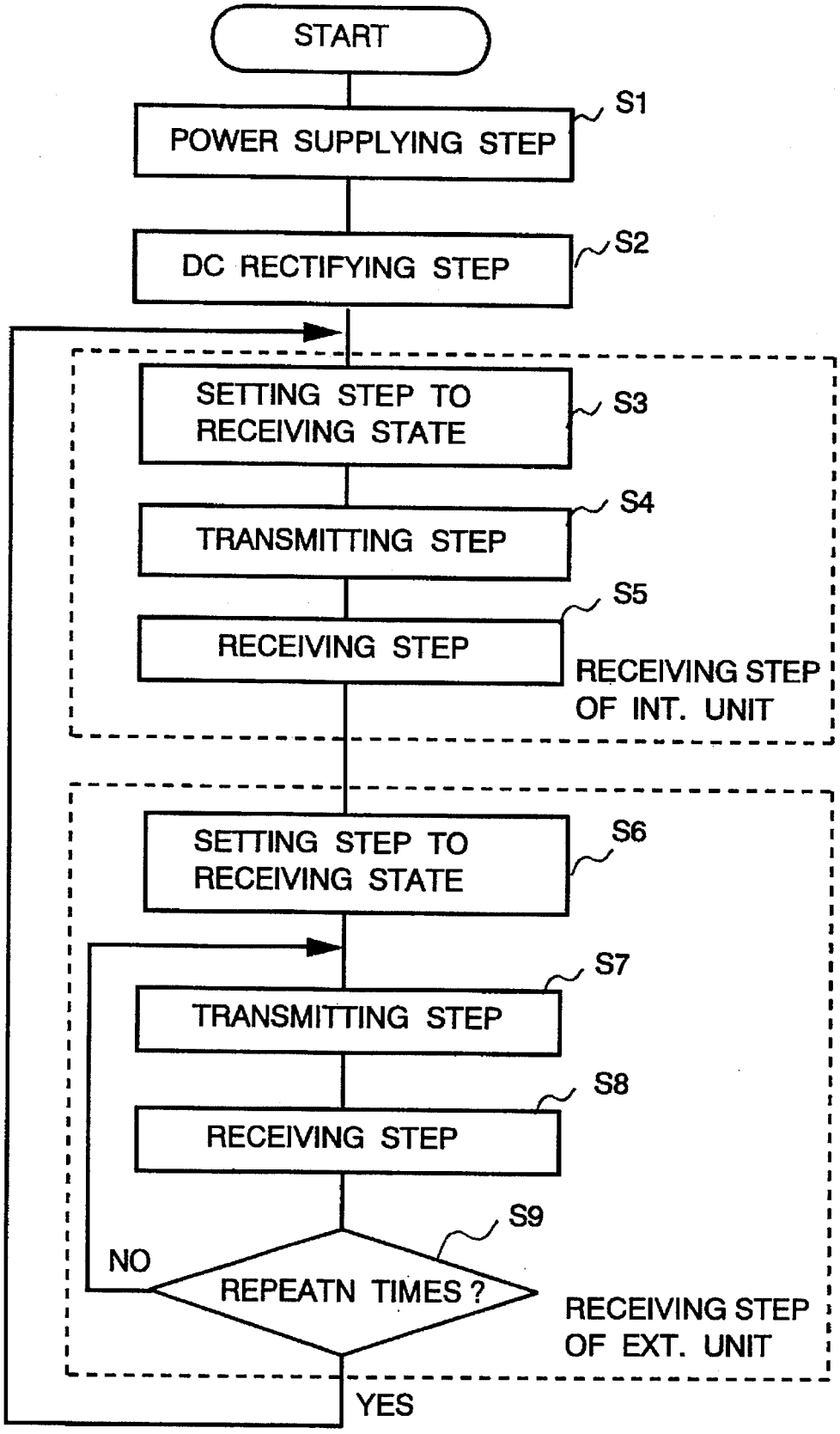
FIG. 2 is a flowchart showing an operation of the control apparatus.
Figure 3:
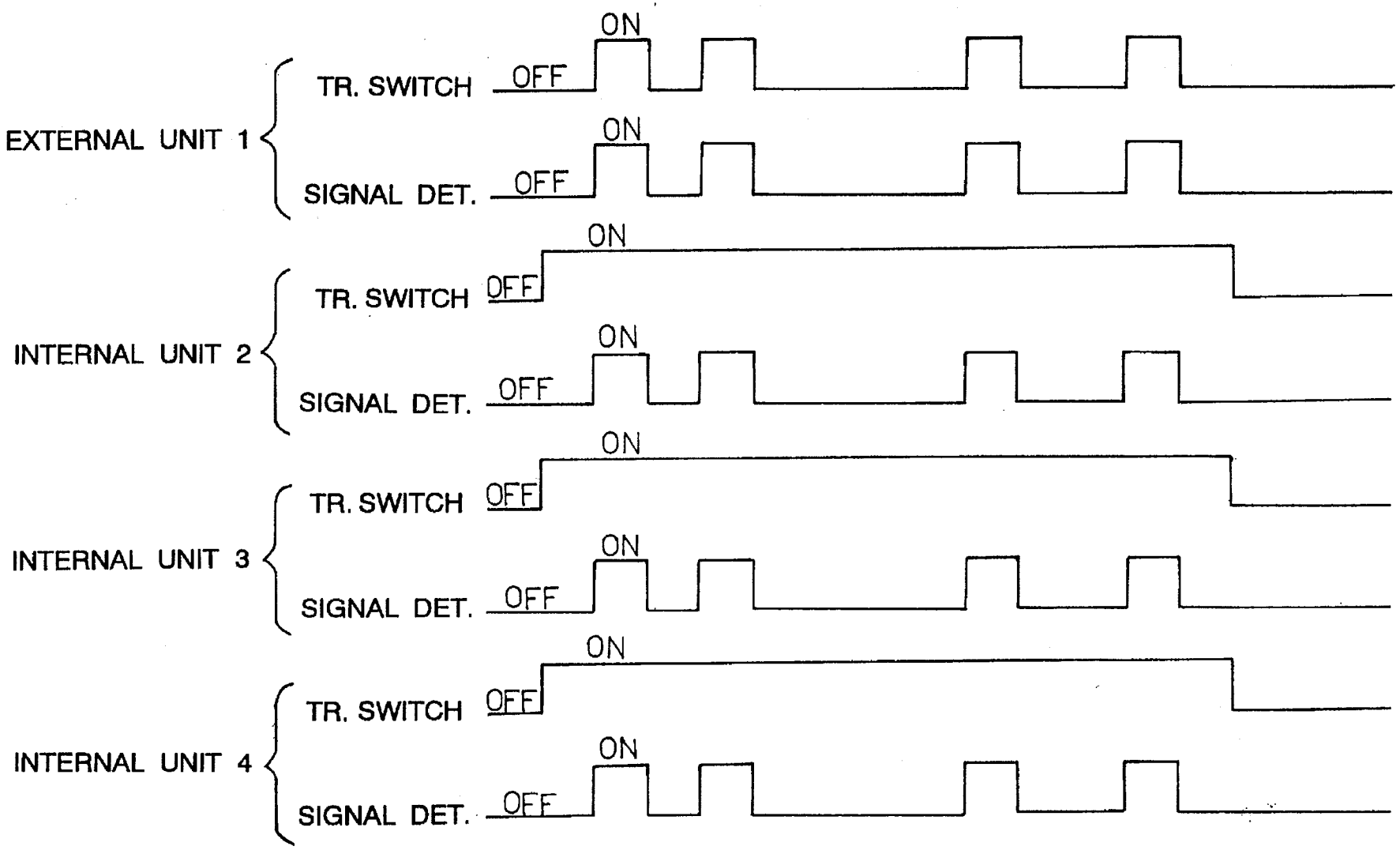
FIG. 3 explains a transmitting operation from an external unit to an internal unit of the control apparatus.
Figure 4:
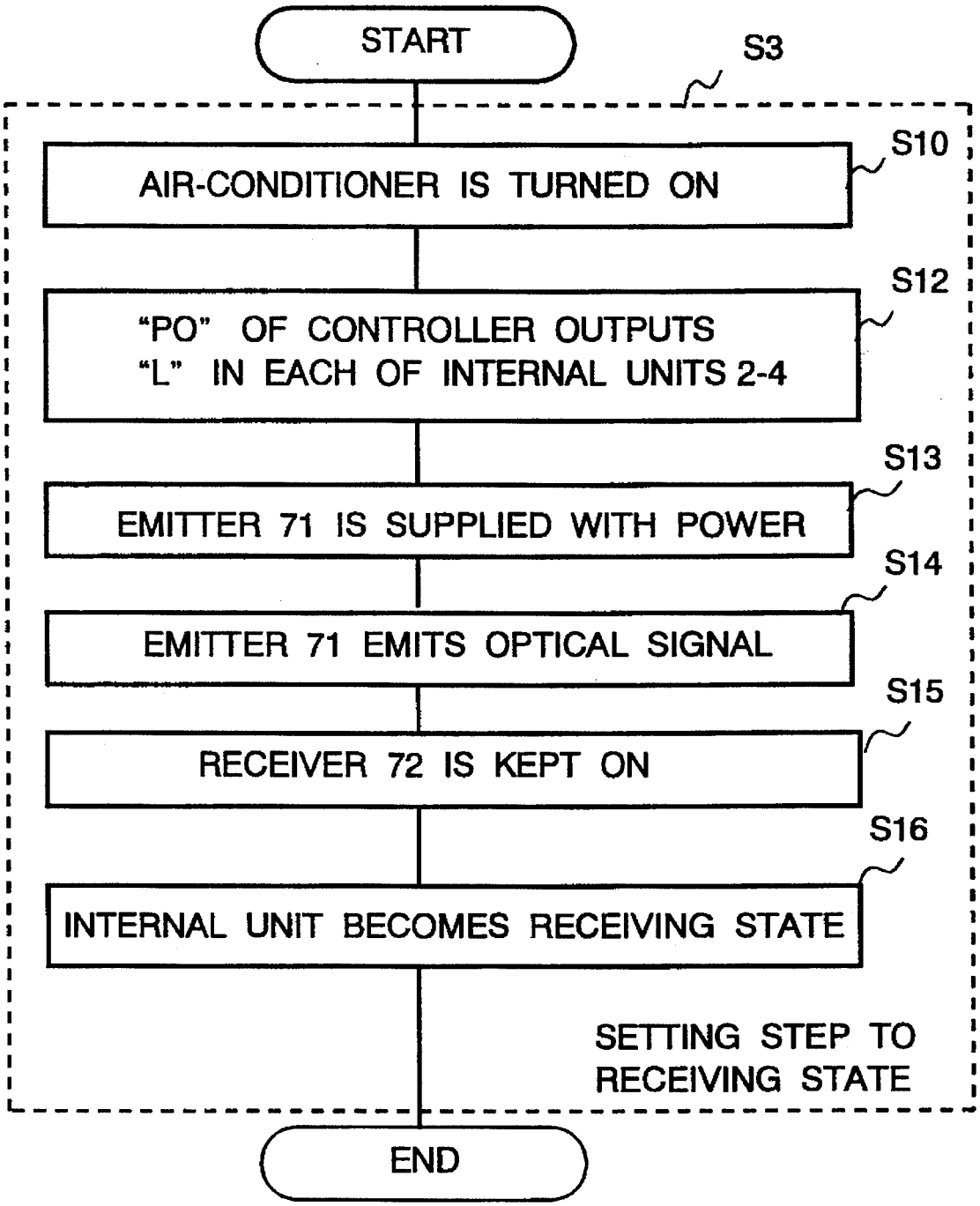
FIG. 4 is a flowchart showing an operation of the control apparatus.

FIG. 2 is a flowchart showing an operation of the control apparatus for the multi-air-conditioner of the first embodiment of the present invention, where the external unit 1 is connected to the plurality of internal units 2–4 via one signal line 5.

In FIG. 2, S1 shows a step for supplying the external unit 1 and the internal units 2–4 with AC current from an AC power supply; S2 shows a step for rectifying the AC current supplied at the above supplying step S1 to DC current; S3 shows a step for setting the internal units 2–4 to a receiving state for data at the starting time of the above rectifying step S2; S4 shows a step for transmitting data by supplying the DC current to the signal line 5 from the external unit 1 alternatively after the internal units 2–4 have been set to the receiving state for data at the above setting step S3; and S5 shows a step for receiving data by detecting whether the signal line 5 is supplied with power or not at the transmitting step S4 at each internal units 2–4.

As described above, S3 to S5 are data receiving steps of the internal units 2–4.

From S6 to S9 are data receiving steps of the external unit 1 as follows: S6 shows a step for setting the external unit 1 to a receiving state for data after data have been transmitted at the above transmitting step S4; S7 shows a step for transmitting data in order of time-division from a plurality of the internal units 2–4 after setting the external unit 1 to the receiving state for data at the above setting step S6; and S8 shows a step for receiving data by the external unit 1 from the plurality of internal units 2–4 via the signal line 5 serially.

The steps S7 and S8 are repeated N times (N is a number of the internal units). The steps from S3 to S9 are repeated until the multi-air-conditioner is turned OFF.

Transmitting data from the external unit 1 to the internal units 2–4 will now be explained by referring to FIGS. 3–6. A DC voltage for transmitting data is almost the same as a Zener voltage of the Zener diode $ZD_1$ (25 V). When the air-conditioner is turned ON (see step S10 in FIG. 4), the internal units 2–4 enter in a receiving state for data. When the air-conditioner is turned ON, the output port PO of the controller 9 of each of the internal units 2–4 outputs a low level signal "L" (see step S12). Then, the emitter 71 of the transmitting switch 7 of each of the internal units 2–4 is supplied with power (see step S13) to emit an optical signal to the receiver 72 of the transmitting switch 7 of each of the internal units 2–4 (see step S14). The receiver 72 of each of the internal units 2–4 is kept ON (see step S15) to enter in the receiving state for data (see step S16).

Figure 5:
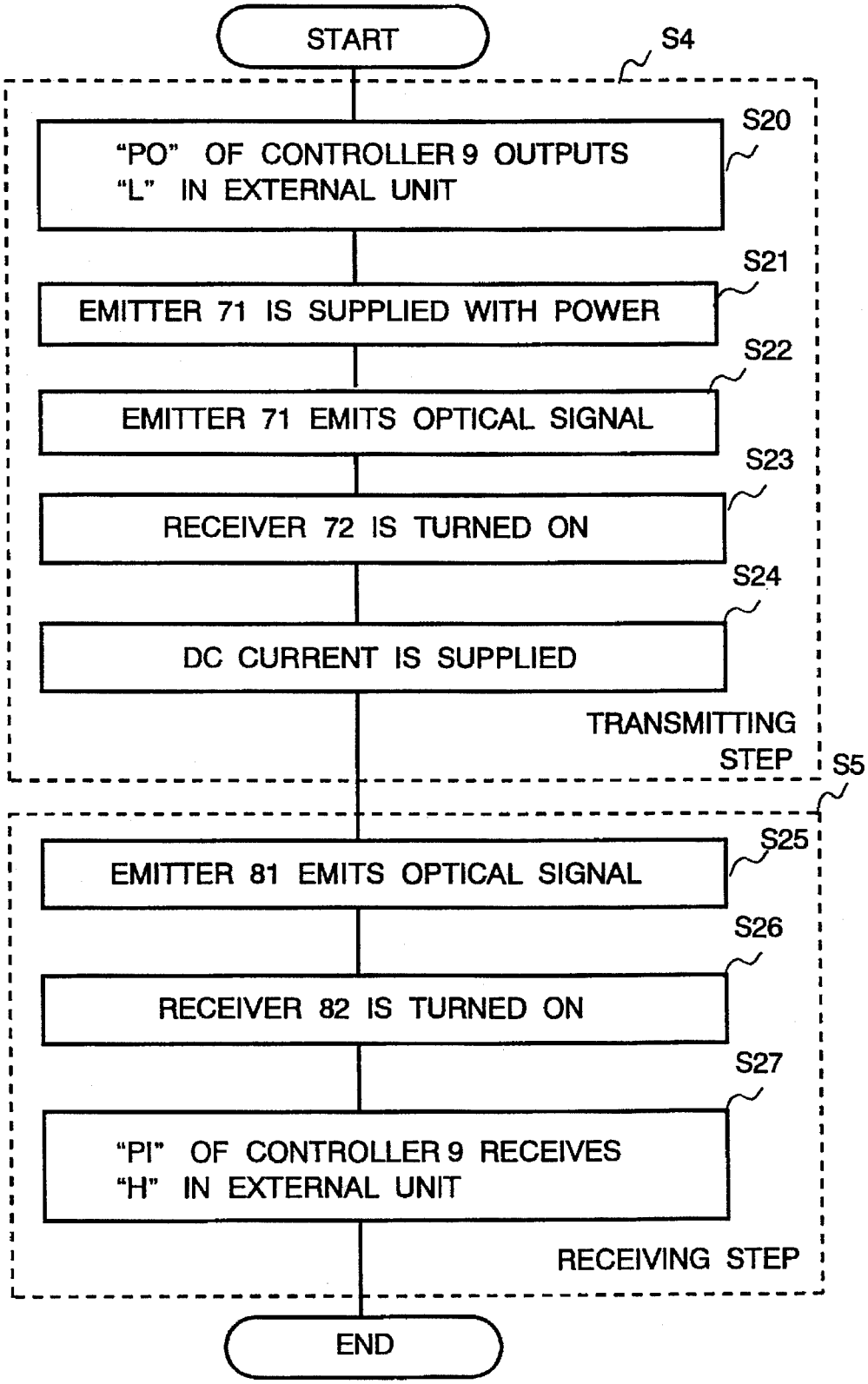
FIG. 5 is a flowchart showing an operation of the control apparatus.

The output port PO of the controller 9 of the external unit 1 outputs a low level signal "L" according to the transmitting data (see step S20 in FIG. 5). The emitter 71 of the transmitting switch 7 of the external unit 1 is supplied with power (see step S21) to emit an optical signal to the receiver 72 of the transmitting switch 7 of the external unit 1 (see step S22). The receiver 72 of the transmitting switch 7 of the external unit 1 is thus turned ON (see step S23) to supply the transmitting/receiving circuit 6 of the external unit 1 and each of the internal units 2–4 with DC current (see step S24). Since the value of the resistance $R_2$ is reduced in this embodiment, a DC voltage supply of the external unit 1 can supply enough electric power to drive the photo-coupler of the signal detector 8 of each of the internal units 2–4 connected in parallel.

On supplying the transmitting/receiving circuit 6 of each of the internal units 2–4 with DC current, the emitter 81 of the signal detector 8 of each of the internal units 2–4 emits the optical signal to the receiver 82 of the signal detector 8 of each of the internal units 2–4 (see step S25). The receiver 82 of the signal detector 8 of each internal units 2–4 is turned ON (see step S26), and the input port PI of the controller 9 of each internal unit receives a high level signal "H" (see step S27).

Figure 6:
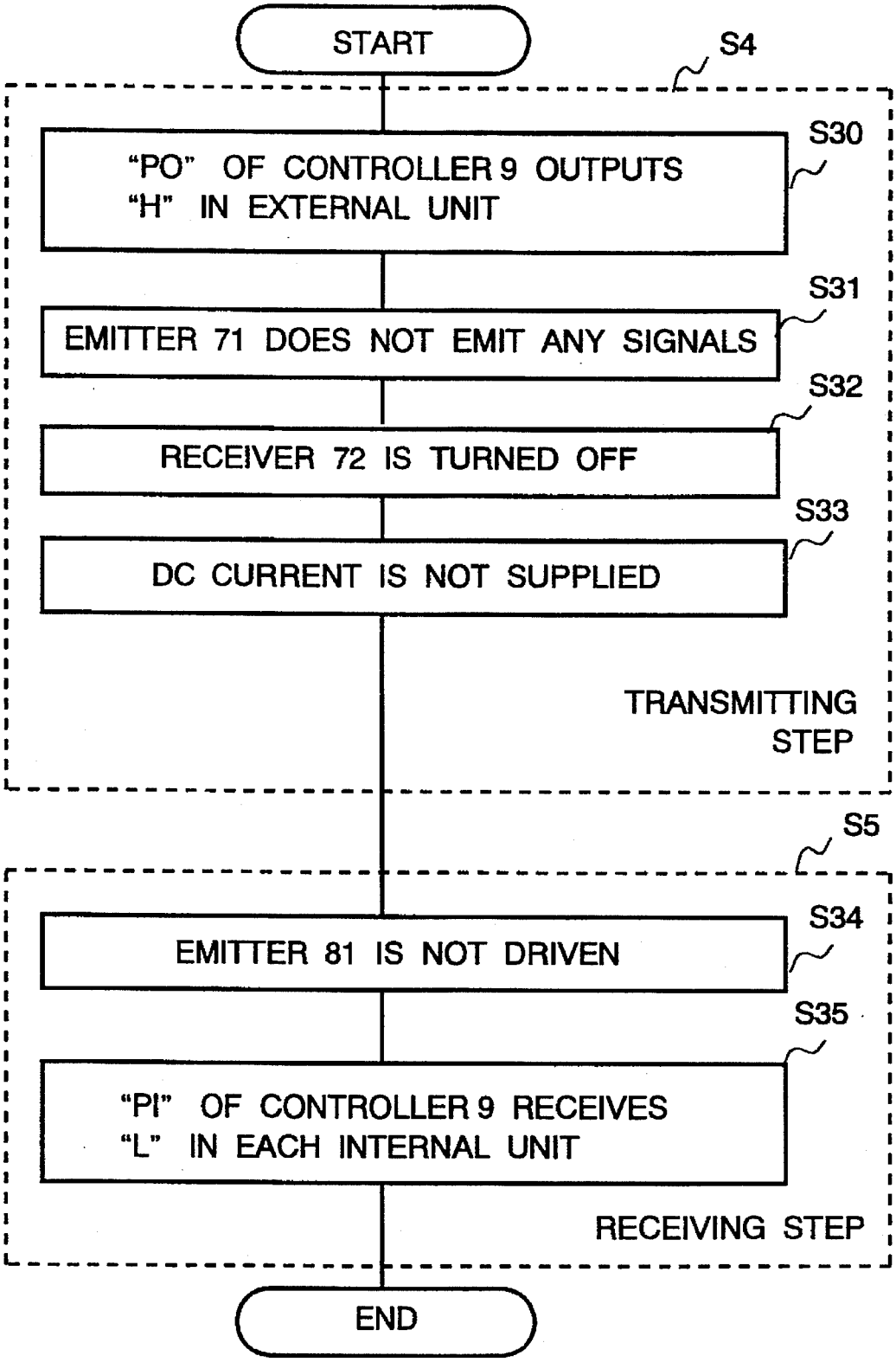
FIG. 6 is a flowchart showing an operation of the control apparatus.

When there is no data to transmit, the output port PO of the controller 9 of the external unit 1 outputs a high-level signal "H" (see step S30 in FIG. 6). At this time, the emitter 71 of the external unit 1 does not emit an optical signal (see step S31), and the receiver 72 of the external unit 1 is thus turned OFF (see step S32). The transmitting/receiving circuit 6 is then not supplied with DC current (see step S33). The emitter 81 of the signal detector 8 of each internal unit 2–4 is then not driven (see step S34), and the input port PI of the controller 9 of each internal unit 2–4 receives a low level signal "L" (see step S35).

Figure 7:
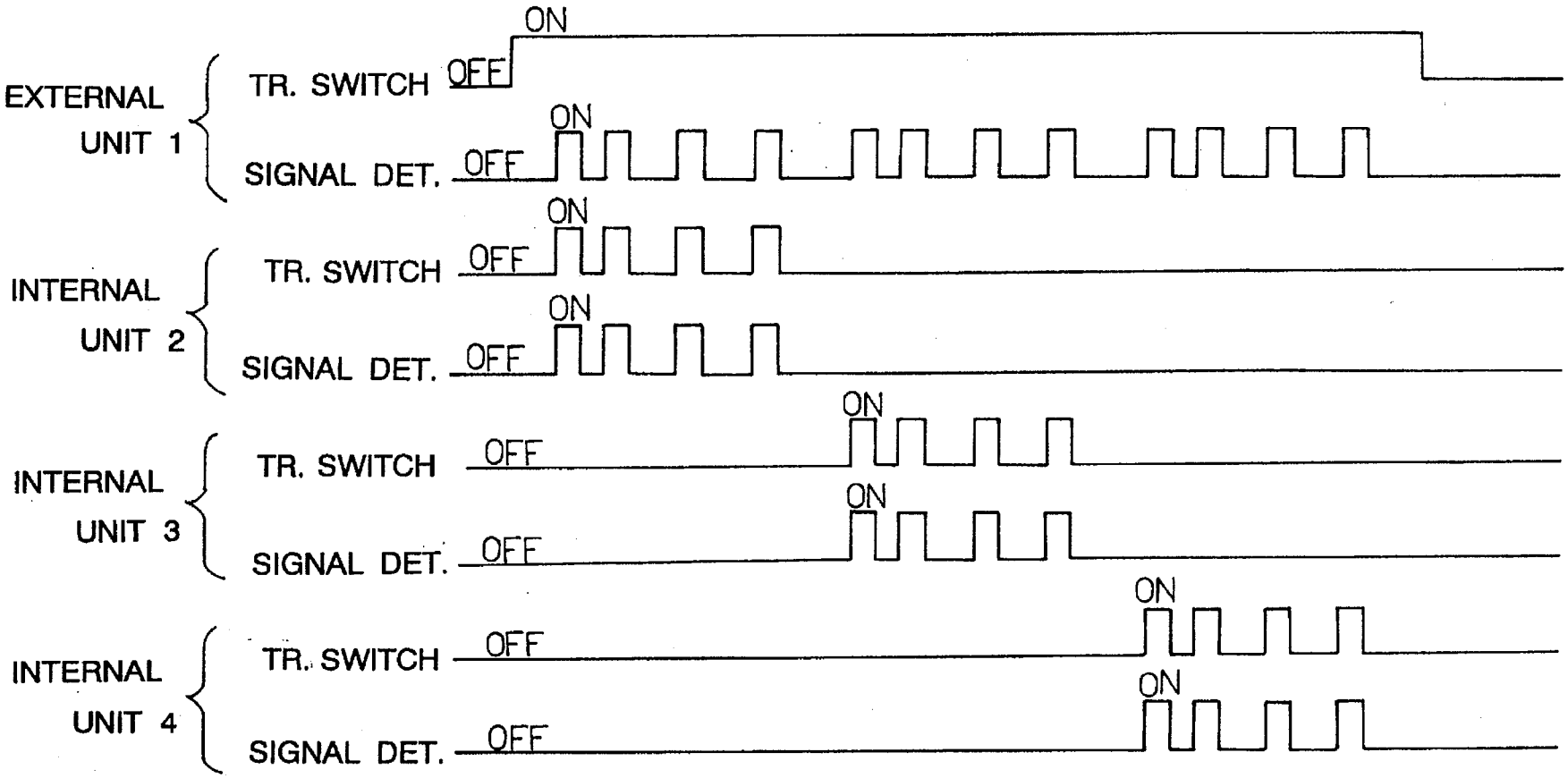
FIG. 7 explains a transmitting operation from the internal unit to the external unit of the control apparatus.
Figure 8:
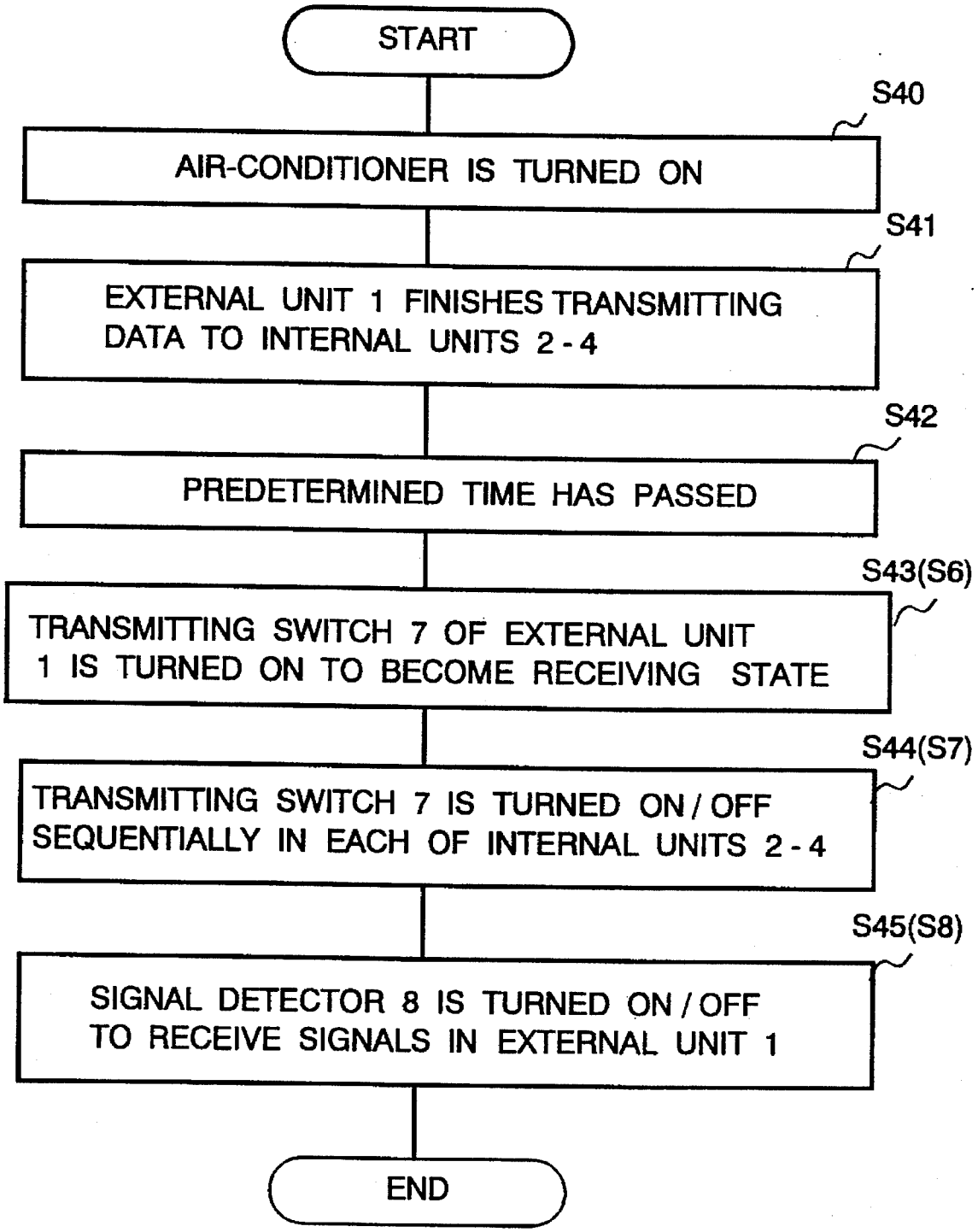
FIG. 8 is a flowchart showing an operation of the control apparatus.

In the following, transmitting data from each of the internal units 2–4 to the external unit 1 will be explained referring to FIGS. 7 and 8. The air-conditioner starts operating at step S40 as shown in FIG. 8. The external unit 1 transmits data to each of the internal units 2–4 (see step S41). When a predetermined time period has elapsed after finishing transmitting data (see step S42), the transmitting switch 7 of the external unit 1 is kept ON to enter in a receiving state for data (see step S43). The transmitting switch 7 of each of the internal units 2–4 is turned ON/OFF sequentially (see step S44), and the signal detector 8 of the external unit 1 is also turned ON/OFF to receive the signal (see step S45).

As described above, the external unit 1 is connected to each of the Internal units 2–4 via the signal line 5 and the commercial power supply lines R and S, which enables an operation to transmit/receive data between the external unit 1 and each of the internal units 2–4 to control the operation of the air-conditioner. Data transmitting is not performed by a commercial power supply but by a DC voltage, which makes a leakage distance of the circuit shorter and thus facilitates the design of the circuit. In this circuit, a transmitting timing of data is not required to be synchronized with the commercial power supply. A transmitting/receiving speed of data can be increased by using a high-speed photo-coupler in the transmitting switch 7 and the signal detector 8, which improves an operation speed of the internal unit of the multi-air-conditioner having a plurality of the internal units 2–4.

Protection for an element of the circuit will now be explained in the following in a case that the signal line 5 is miswired.

For a first example, the signal line 5 of the external unit 1 is supposed to be miswired to an R phase of a commercial power supply. If an electrical potential of an S phase of a commercial power is higher than the R phase of the commercial power and the receiver 72 is OFF, the commercial power is cut off by the receiver 72 because the receiver 72 is capable of withstanding a high voltage in this embodiment. If an electrical potential of the R phase of the commercial power is higher than the S phase of the commercial power, the commercial power is cut off by the diode $D_2$ capable of withstanding a high voltage. When the signal line 5 and the commercial power supply line S are miswired to another commercial power supply, the commercial AC power of the external unit is also cut off by the receiver 72 and the diode $D_2$ in a case that the receiver 72 is OFF. The circuit element placed between the signal line 5 and the commercial power supply line S is thus protected.

The circuit element is protected in the same way as the related art of FIG. 13 in a case that the signal line 5 of each of the internal units 2–4 is miswired to an R phase of the commercial power. When the electrical potential of the R phase of the commercial power is higher than the S phase of the commercial power, and also when the potential difference between the R phase of the commercial power and the S phase of the commercial power is greater than a Zener voltage of the Zener diode $ZD_2$, the transmitting/receiving circuit 6 of the Internal unit is supplied with the Zener voltage of the Zener diode $ZD_2$. The transmitting/receiving circuit 6 of each of the internal units 2–4 is protected by dissipating a voltage difference with the resistance $R_3$. When the electrical potential of the S phase of the commercial power is higher than the R phase of the commercial power, the transmitting/receiving circuit 6 of each of the internal units 2–4 is protected by cutting off the commercial power with the diode $D_4$ capable of withstanding a high voltage to cut off commercial power.

When the circuit between the signal line 5 and the power supply line S is short-circuited, the transmitting switch 7, the signal detector 8 and the diode $D_2$ are protected by restricting an electric current with the resistance $R_2$ as well as the related art of FIG. 13.

According to this embodiment, data transmitting is not performed by a commercial power supply but by DC voltage. The circuit may have a shorter leakage distance and a smaller circuit board, and thus a simpler design. In this circuit, a transmitting timing of a signal is not required to be synchronized with a commercial power supply. A transmitting speed can be improved by providing a high-speed photo-coupler in the transmitting switch 7, which improves an operation speed of the internal units 2–4 of the multi-air-conditioner having a plurality of the internal units 2–4.

According to this embodiment, the transmitting switch 7 capable of withstanding a high voltage and the diode $D_2$ capable of withstanding a high voltage are provided with the external unit 1. Even if the signal line 5 and the commercial power supply line S are miswired to the commercial power and also the transmitting switch 7 is OFF, the circuit elements of the external unit 1 connected to the circuit between the signal line 5 and the commercial power supply line S are protected by cutting off commercial power with the transmitting switch 7 and the diode $D_2$.

Further, according to this embodiment, even if the circuit between the signal line 5 and the power supply line S is short-circuited, the circuit elements of the external unit 1 are protected by restricting electric current with the resistance $R_2$.

As described above, in the first embodiment, the photo-coupler capable of withstanding a high voltage of the transmitting switch of the external unit protects the circuit elements of the external unit when the signal line is miswired to the commercial power. However, for example, in a case that the micro computer of the controller 9 of the external unit 1 runs away to supply the transmitting switch with power, the circuit elements of the external unit 1 cannot be protected when the signal line 5 is miswired to the commercial power in the control apparatus according to the first embodiment. In the second embodiment, a different voltage detector is provided for suspending an operation of the transmitting switch of the external unit 1 by H/W (Hard Ware), so that the circuit elements of the external unit 1 are protected from influence of the failure of the controller 9 even if the signal line 5 is miswired to the commercial power.

Figure 9:
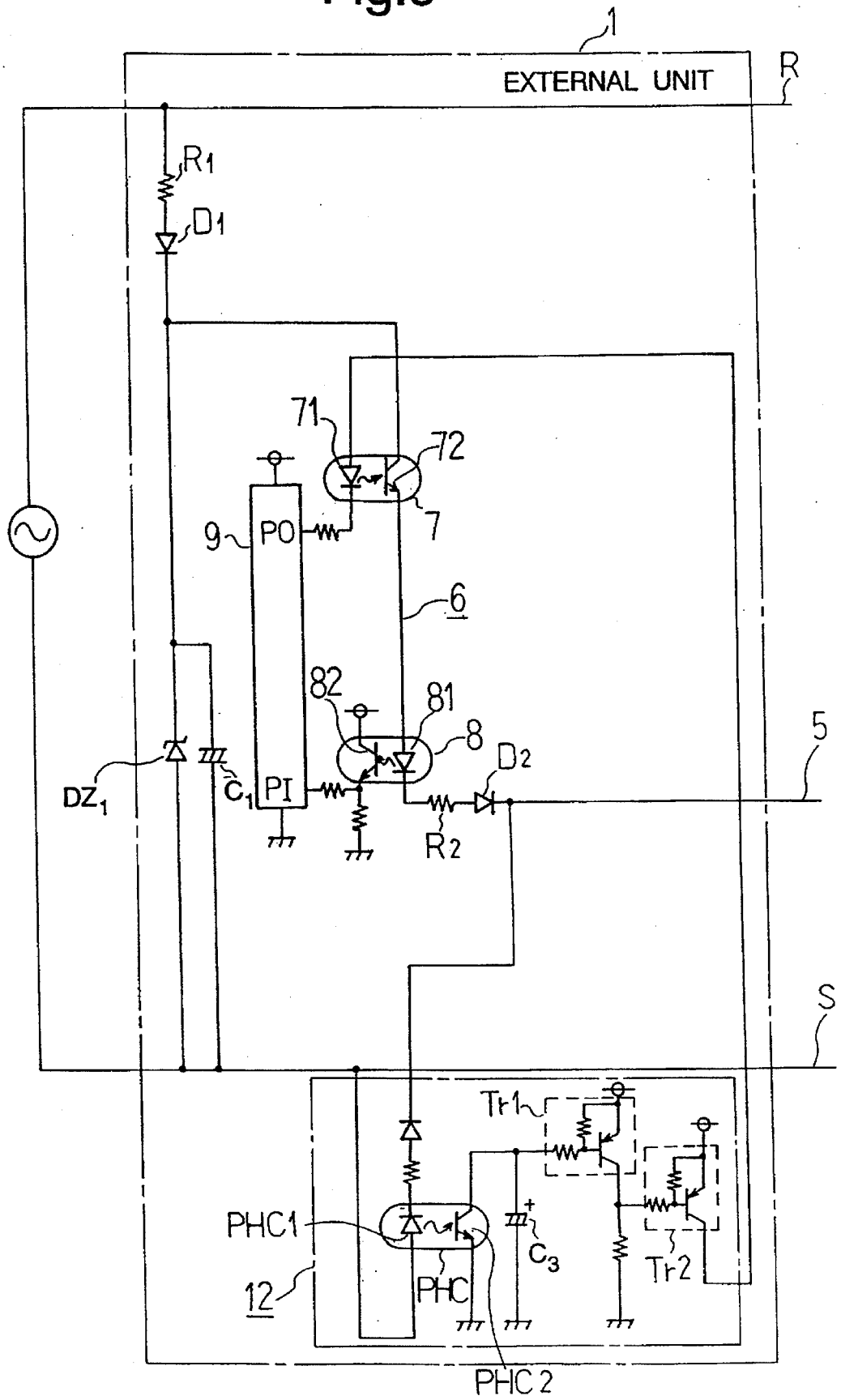
FIG. 9 shows a circuit of another control apparatus for a multi-air-conditioner according to a second embodiment of the present invention.
Figure 10:
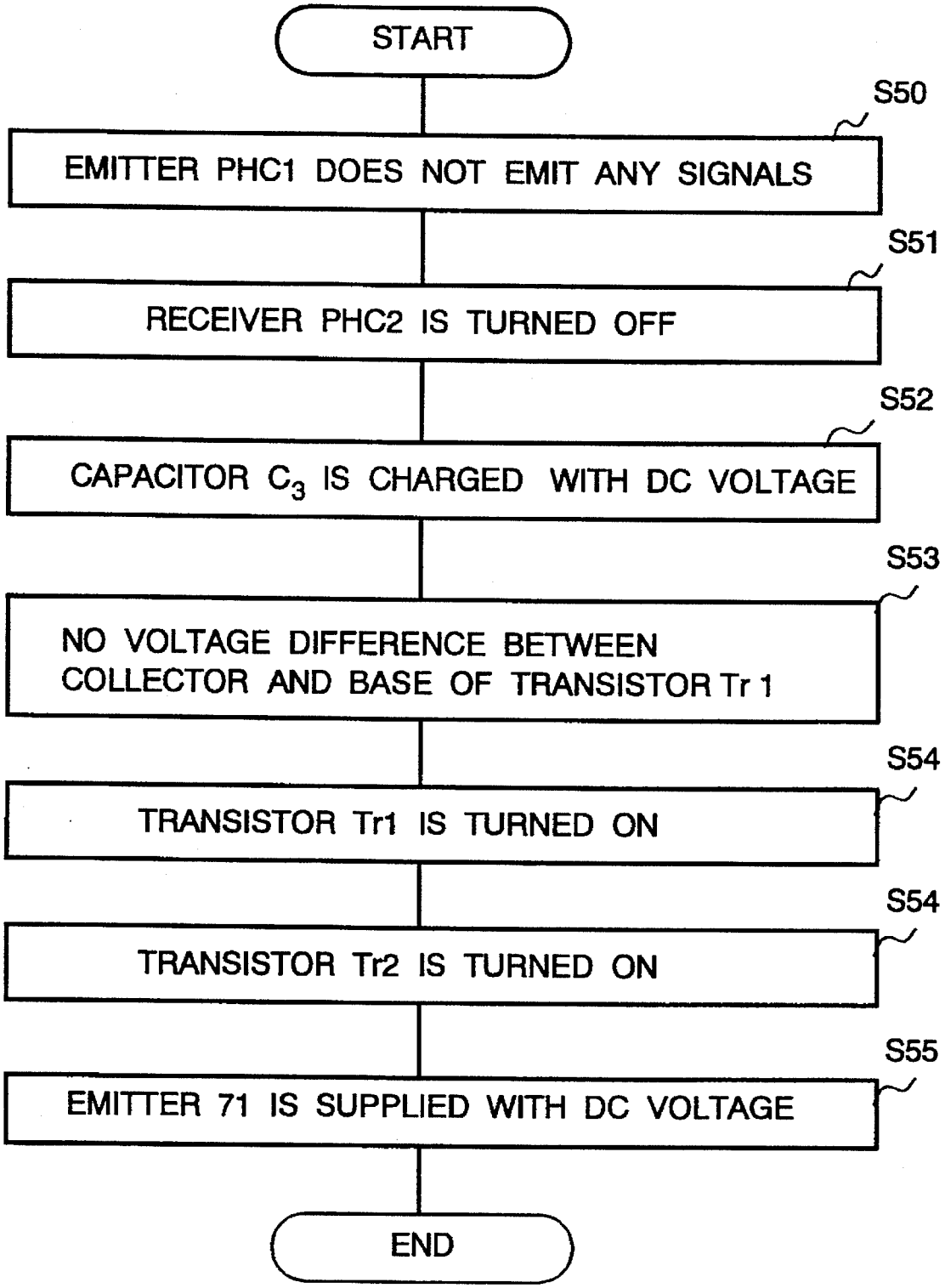
FIG. 10 is a flowchart showing an operation of the control apparatus.
Figure 11:
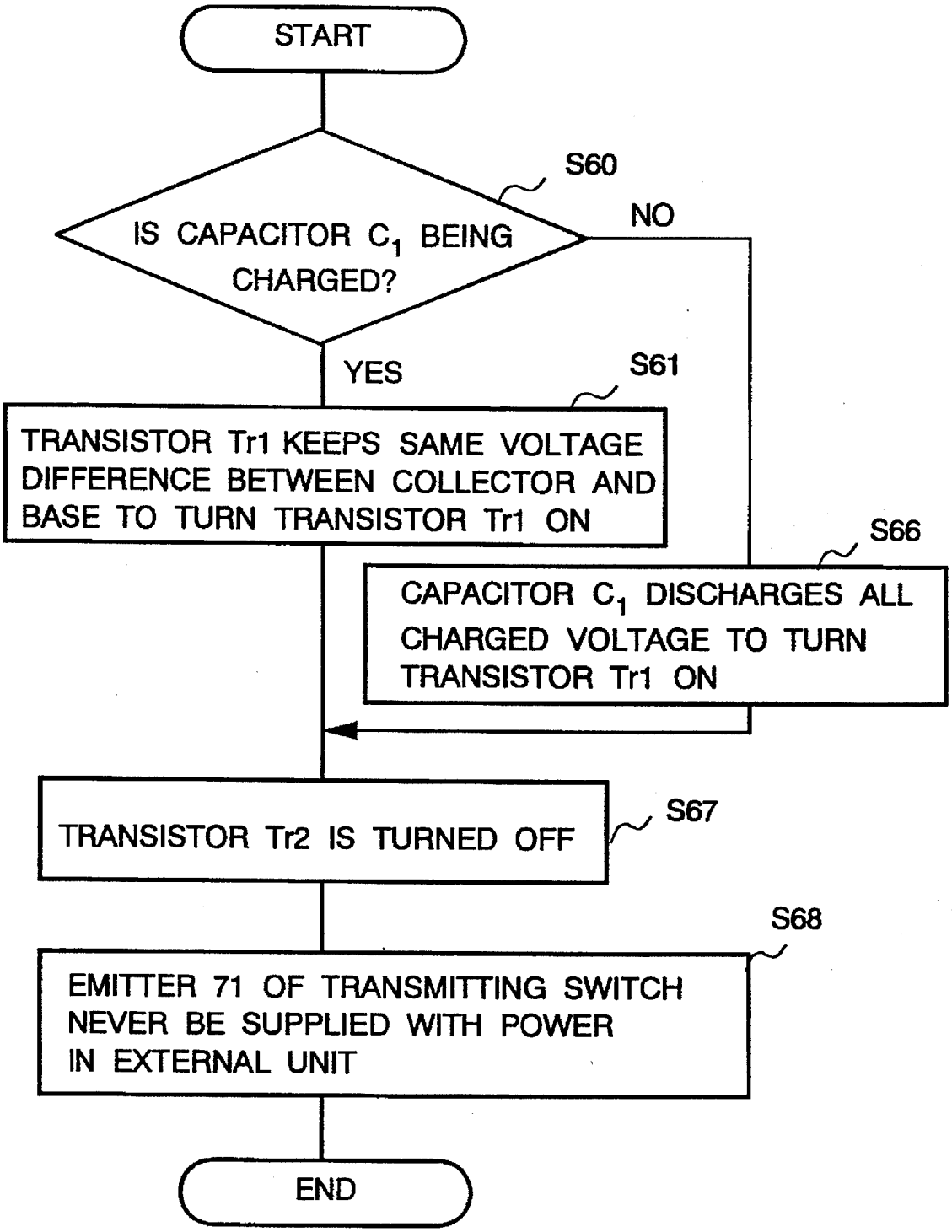
FIG. 11 is a flowchart showing an operation of the control apparatus.
Figure 12:
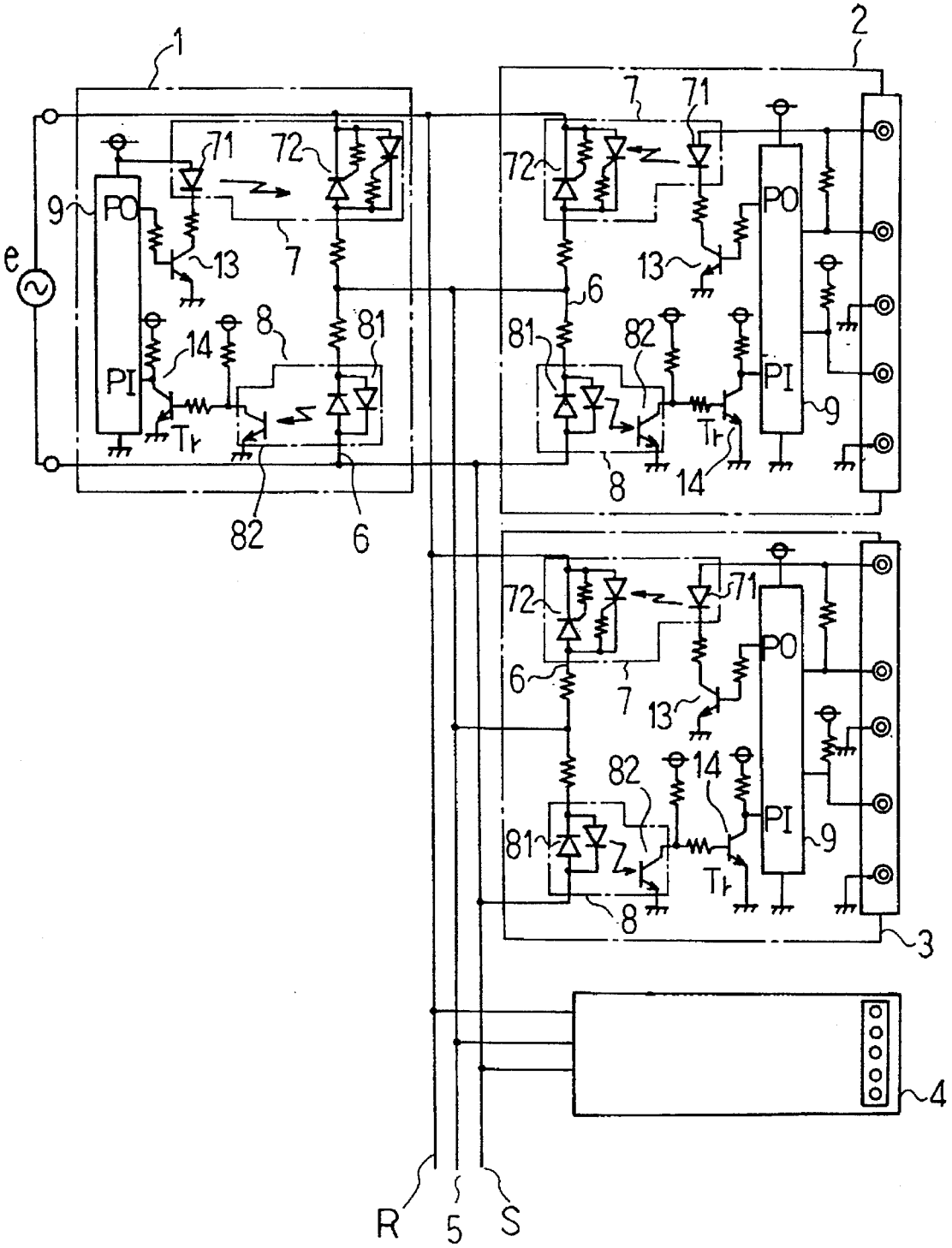
Fig.12 RELATED ART
FIG. 12 shows a circuit of a conventional control apparatus for a multi-air-conditioner according to Related Art.

The second embodiment will now be explained in the following by referring to FIGS. 9–11. FIG. 9 shows a circuit of the control apparatus for the multi-air-conditioner according to the second embodiment of the present invention.

In FIG. 9, a different voltage detector 12 is provided between the signal line 5 of the external unit 1 and the commercial power supply line S. The different voltage detector 12 includes a photo-coupler PHC. The photo-coupler PHC includes of an emitter PHC1 for emitting an optical signal in a case that the commercial power is provided between the signal line 5 and the commercial power supply line S and a receiver PHC2 for receiving an optical signal from the emitter PHC1. A base of a transistor Tr1 is connected with the receiver PHC2 and a capacitor $C_1$. The transistor Tr1 is driven based on ON/OFF of the receiver PHC2. A base of a transistor Tr2 is connected with the emitter of the transistor Tr1. The transistor Tr2 is driven based on ON/OFF of the Tr1. The emitter of the transistor Tr2 is connected with the emitter 71 of the transmitting switch of the external unit 1.

An operation of the second embodiment will now be explained hereinafter by referring to FIG. 10. The different voltage detector 12 is provided between the signal line 5 and the commercial power supply line S as shown in FIG. 9. When the signal line and the S phase of the commercial power are provided with the signal line 5 and the commercial power supply line S, the emitter PHC1 of the photo-coupler PHC of the different voltage detector 12 does not emit an optical signal (see step S50 in FIG. 10). The receiver PHC2 is turned OFF (see step S51). A capacitor $C_3$ is charged with DC voltage (see step S52), the voltage of the collector of the transistor Tr1 has no difference with the voltage of the base (see step S53), and the transistor Tr1 is turned OFF (see step S54). When the transistor Tr1 is OFF, the transistor Tr2 is turned ON (see step S54) because of the voltage difference between the collector and the base of the transistor Tr2. The emitter 71 of the transmitting switch of the external unit 1 is then supplied with DC voltage (see step S55).

When the R phase and S phase of the commercial power are provided with the signal line 5 and the commercial power supply line S, the emitter PHC1 of the photo-coupler PHC of the different voltage detector 12 is turned ON and OFF alternatively every half cycle of the AC commercial power. The emitter PHC2 is supplied with power and cut off power alternatively, which causes capacitor $C_1$ to charge and to discharge alternatively. When the capacitor $C_1$ is charged (see step S60 in FIG. 11), the transistor Tr1 is turned ON. The voltage of the collector and the voltage of the base keeps the same voltage difference and the transistor Tr1 is turned ON (see step S61). When the capacitor $C_1$ is discharged, the capacitor $C_1$ discharges all the charged voltage to turn the transistor Tr1 ON (see step S66). The voltage difference between the emitter and the base of the transistor Tr2 may thus be reduced to turn the transistor Tr2 OFF (see step S67). The emitter 71 of the transmitting switch of the external unit 1 is then never supplied with power (see step S68).

The operation is the same as described above in a case that another commercial power is provided with the signal line 5 and the commercial power supply line S. Namely, the emitter 71 of the transmitting switch 7 of the external unit 1 is never supplied with power to keep the receiver 72 of the transmitting switch 7 of the external unit 1 OFF.

Providing the different voltage detector 12 prevents the receiver 72 of the transmitting switch 7 of the external unit 1 from turning ON through the controller 9 in a case that the commercial power is provided with the signal line 5 and the commercial power supply line S. The circuit elements between the signal line 5 and the commercial power supply line S can be protected by cutting off the commercial power with the receiver 72 of the transmitting switch 7 of the external unit 1, which is capable of withstanding a high voltage and cutting off commercial power, and the diode 10 which is capable of cutting off commercial power.

According to the second embodiment of the present invention, in the control apparatus for the multi-air-conditioner, the circuit elements of the external unit 1 can be protected by turning the transmitting switch OFF in a case that the micro computer of the control apparatus 9 runs away when the commercial power is miswired to the signal line 5.

Having thus described several particular embodiments of the present invention, various alterations, modifications, and improvements will readily occur to those skilled in the art. Such alterations, modifications, and improvements are intended to be part of this disclosure, and are intended to be within the spirit and scope of the present invention. Accordingly, the foregoing description is by way of example only, and is not intended to be limiting. The present invention is limited only as defined in the following claims and the equivalents thereto.

What is claimed as new and desired to be secured by Letters Patent of the United States is:

1. A control apparatus for a multi-air-conditioner having an external unit supplied with electric power from an AC electric power supply and a plurality of internal units, a first AC power supply line and a second AC power supply line for supplying the plurality of internal units with electric power from the external unit and a signal line for transmitting data to control an operation of the multi-air-conditioner, the control apparatus comprising:

a DC electric power supply provided with the external unit for rectifying the AC electric current from the AC electric power supply to a DC electric current;

an external transmitting/receiving circuit provided with the external unit and connected with the DC electric power supply;

a plurality of internal transmitting/receiving circuits respectively provided with the plurality of internal units and connected serially with the external transmitting/receiving circuit via the signal line;

wherein the DC electric power supply, the external transmitting/receiving circuit, the signal line, the plurality of internal transmitting/receiving circuits and the first AC power supply line form a closed circuit; and wherein the plurality of internal transmitting/receiving circuits are connected in parallel with each other between the signal line and the first AC power supply line.

2. The control apparatus for the multi-air-conditioner according to claim 1, further comprising:

a plurality of controllers for transmitting data respectively provided with the external unit and the plurality of internal units;

wherein each of the external transmitting/receiving circuit and the plurality of internal transmitting/receiving circuits includes a transmitting switch for alternatively supplying the DC electric current to the signal line according to the data transmitted by the plurality of controllers;

wherein each of the external transmitting/receiving circuit and the plurality of internal transmitting/receiving circuits includes a signal detector for detecting whether the signal line is supplied with power or not and outputting the detected data as a receiving data to the plurality of controllers; and wherein the transmitting switch and the signal detector are connected serially.

3. The control apparatus for the multi-air-conditioner according to claim 2, wherein each transmitting switch comprises a photo-coupler including an emitter and a receiver for one of supplying and cutting off electric power in one direction.

4. The control apparatus for the multi-air-conditioner according to claim 3, wherein the transmitting switch of the external transmitting/receiving circuit includes a protecting circuit for protecting a circuit element in a case of miswiring the signal line.

5. The control apparatus for the multi-air-conditioner according to claim 4, wherein the receiver of each photo-coupler is capable of withstanding a high voltage to cut off AC power supply in case the signal line is miswired to the AC power supply.

6. The control apparatus for the multi-air-conditioner according to claim 1, further comprising:

a diode provided between the external transmitting/receiving circuit of the external unit and the signal line which is capable of withstanding a high voltage to cut off AC power supply in a case of miswiring the signal line to the AC electric power supply.

7. The control apparatus for the multi-air-conditioner according to claim 1, further comprising:

a resistance provided between the external transmitting/receiving circuit and the signal line and having a predetermined resistance value to transmit data simultaneously to each of the plurality of internal transmitting/receiving circuits of the plurality of internal units.

8. The control apparatus for the multi-air-conditioner according to claim 7, wherein the predetermined resistance of the external transmitting/receiving circuit restricts a short-circuit current in a case that a circuit between the signal line of the external unit and the first AC power supply line is short-circuited.

9. The control apparatus for the multi-air-conditioner according to claim 3, further comprising:

a different voltage detector located between the signal line of the external unit and the first AC power supply line for detecting a different voltage and for suspending an operation of the transmitting switch of the external transmitting/receiving circuit in a case that the signal line is miswired to the AC power supply.

10. The control apparatus for the multi-air-conditioner according to claim 9, wherein the different voltage detector includes an AC current detector for detecting AC electric current from the AC electric power supply.

11. The control apparatus for the multi-air-conditioner according to claim 10, wherein the AC current detector comprises:

a photo-coupler provided between the signal line and the first AC power supply line, a capacitor connected in parallel with the photo-coupler, and a transistor operated based on an output of the photo-coupler and an output of the capacitor.

12. The control apparatus for the multi-air-conditioner according to claim 11, wherein the capacitor of the AC current detector controls a supply of electric current to an emitter of the photo-coupler of the transmitting switch.

13. A control method for a multi-air-conditioner having an external unit and a plurality of internal units connected with a signal line, comprising the steps of:

(a) supplying the external unit and the plurality of internal units with AC electric current from an AC power supply;

(b) rectifying the AC electric current supplied at the supplying step to a DC electric current;

(c) setting the plurality of internal units to a receiving state on starting the rectifying step;

(d) transmitting data by alternatively supplying the signal line with DC electric current based on data transmitted from the external unit after setting the plurality of internal units to the receiving state at the setting step; and (e) receiving data at each of the plurality of internal units by detecting whether the plurality of internal units are supplied with electric current or not at the transmitting step.

14. The control method for the multi-air-conditioner according to claim 13, further comprising a step of cutting off the AC power supply.

15. The control method for the multi-air-conditioner according to claim 14, wherein the cutting off step cuts off the AC power supply by a transmitting switch provided with an external transmitting/receiving circuit of the external unit and which is capable of withstanding a high voltage.

16. A control method for a multi-air-conditioner having an external unit and a plurality of internal units connected with a signal line, comprising the steps of:

(a) supplying an AC electric current to the external unit and the plurality of internal units from an AC electric power supply;

(b) rectifying the AC electric current supplied at the supplying step to a DC electric current;

(c) transmitting data to the plurality of internal units from the external unit via the signal line;

(d) setting the external unit to a receiving state after transmitting data at the transmitting step;

(e) transmitting data time-divisionally and serially from the plurality of internal units to the signal line after setting the external unit to the receiving state at the setting step; and (f) receiving data of the plurality of internal units serially from the signal line by the external unit.

17. A control apparatus for a multi-air-conditioner having an external unit supplied with power from at least one commercial power supply line and a plurality of internal units connected with a signal line for serially transmitting data between the external unit and the plurality of internal units to control an operation of the multi-air-conditioner, the control apparatus comprising:

a DC electric power supply for rectifying commercial electric power supply supplied to the external unit to a DC electric power supply;

an external transmitting/receiving circuit connected to the DC electric power supply;

a plurality of internal transmitting/receiving circuits respectively provided with the plurality of internal units and connected serially with the external transmitting/receiving circuit via the signal line;

wherein the DC electric power supply, the external transmitting/receiving circuit, the signal line, the plurality of internal transmitting/receiving circuits and the at least one commercial power supply line form a closed circuit;

wherein the plurality of internal transmitting/receiving circuits of the plurality of internal units are connected in parallel to each other between the signal line and the at least one commercial power supply line; and wherein each of the external transmitting/receiving circuit and the plurality of internal transmitting/receiving circuits comprises:

a transmitting switch for alternatively supplying the transmitting/receiving circuit with the DC electric power supply based on data transmitted from a controller, and a signal detector connected serially with the transmitting switch for detecting whether the transmitting/receiving circuit is supplied with power or not and outputting the detected data as a receiving data to the controller.

18. The control apparatus for the multi-air-conditioner according to claim 17, further comprising:

a transmitting switch provided with the external transmitting/receiving circuit and which is capable of withstanding a high voltage to cut off the at least one commercial power supply; and a diode provided between the external transmitting/receiving circuit and the signal line and which is capable of withstanding a high voltage to cut off the commercial power supply in a case that the signal line is miswired to the commercial power supply.

19. The control apparatus for the multi-air-conditioner according to claim 17, further comprising:

a resistance provided between the external transmitting/receiving circuit and the signal line and having a predetermined resistance value to transmit data simultaneously to each of the plurality of internal transmitting/receiving circuits of the plurality of internal units for restricting a short-circuit current in a case that a circuit between the signal line and the at least one power supply line is short-circuited.

20. The control apparatus for the multi-air-conditioner according to claim 18, further comprising:

a different voltage detector provided between the signal line of the external unit and the at least one power supply line for suspending an operation of the transmitting switch of the external transmitting/receiving circuit in a case that the signal line is miswired to the at least one commercial power supply.

* * * * *